US007008740B2

(12) United States Patent
Fukuda

(10) Patent No.: US 7,008,740 B2
(45) Date of Patent: Mar. 7, 2006

(54) TRANSFER MEMBER AND MANUFACTURING METHOD THEREOF, AND IMAGE FORMING APPARATUS USING THE SAME

(75) Inventor: Shigeru Fukuda, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/671,699

(22) Filed: Sep. 29, 2003

(65) Prior Publication Data

US 2004/0179871 A1 Sep. 16, 2004

(30) Foreign Application Priority Data

Mar. 13, 2003 (JP) ..... 2003-067875

(51) Int. Cl.
*G03G 7/00* (2006.01)
*G03G 13/16* (2006.01)
*G03G 15/16* (2006.01)

(52) U.S. Cl. ..... 430/47; 430/104; 430/126; 524/495; 524/496; 399/302

(58) Field of Classification Search ..... 430/47, 430/126, 104; 524/495, 496; 399/302
See application file for complete search history.

(56) References Cited

U.S. PATENT DOCUMENTS 6,303,054 B1 * 10/2001 Kanetake et al. ..... 252/511
6,352,750 B1 * 3/2002 Kanetake ..... 428/36.9
6,646,040 B1 * 11/2003 Hara et al. ..... 524/495
2002/0141784 A1 * 10/2002 Kusayanagi et al. ..... 399/179
2003/0157420 A1 * 8/2003 Bando et al. ..... 430/124

FOREIGN PATENT DOCUMENTS

| | | |
|---|---|---|
| JP | B2 2560727 | 9/1996 |
| JP | A 2000-355432 | 12/2000 |
| JP | A 2001-34074 | 2/2001 |
| JP | A 2001-106797 | 4/2001 |
| JP | A 2001-342344 | 12/2001 |

* cited by examiner

*Primary Examiner*—Richard L. Schilling
(74) *Attorney, Agent, or Firm*—Oliff & Berridge PLC

(57) ABSTRACT

The present invention provides a transfer member containing a polyimide resin and carbon black. The carbon black has a pH value of no more than 5 and a volatile component of at least 3.5%, and the content of carbon black is 22 to 30 parts by weight relative to 100 parts by weight of the polyimide resin. The invention also provides a method for manufacturing a transfer member comprising the steps of: dividing a poly(amic acid) resin solution containing carbon black into plural portions, and mixing the divided solutions by allowed the solutions to collide with each other at a pressure of at least 150 MPa; and forming a transfer member containing the polyimide resin using the poly(amic acid) resin solution, which has the carbon black mixed therein. The invention further provides an image forming apparatus using the transfer member above.

13 Claims, 3 Drawing Sheets

TRANSFER MEMBER AND MANUFACTURING METHOD THEREOF, AND IMAGE FORMING APPARATUS USING THE SAME

CROSS-REFERENCE TO RELATED APPLICATIONS

This application claims benefit of and priority to Japanese Patent Application No. 2003-67875, filed on Mar. 13, 2003, which is incorporated herein by reference in its entirety for all purposes.

BACKGROUND OF THE INVENTION

1. Field of the Invention

The present invention relates to a transfer member such as an intermediate transfer body used by an electrostatic copying system image forming apparatus such as a copying machine or printer.

2. Description of the Related Art

In an electrostatic copying system image forming apparatus, an image bearing body comprising a photoconductive photosensitive material is uniformly electrified, an electrostatic latent image is formed with a laser beam obtained by modulating image signals, and a visible toner image is obtained by developing the electrostatic latent image with an electrified toner.

A so-called intermediate transfer system image forming apparatus is one of such image forming apparatus, wherein a desired reproduction image is obtained by electrostatic transferring the toner image via an intermediate transfer body. For example, Japanese Patent Application Laid-Open (JP-A) No. 62-206567 discloses such an image forming apparatus.

Examples of the material of the intermediate transfer body used in the image forming apparatus employing the intermediate transfer process using the intermediate transfer body include electroconductive endless belts of thermoplastic resins such as polycarbonate resins disclosed in JP-A No. 06-095521, PVDF (polyvinylidene fluoride) resins disclosed in JP-A Nos. 5-200904 and 6-228335, and polyalkylene phthalate resins disclosed in JP-A No. 6-149081; and polyimide resins and polyamide imide resins disclosed in Japanese Patent No. 2560727.

Aromatic polyimide resins are preferably used for the intermediate transfer body (transfer member) since such resins have high mechanical strength. The resistivity of the transfer member should be restricted to a prescribed range, and it is well known that the carbon black is blended with the resin for controlling the resistivity. However, irregular transfer or transferred image distortion may occur in this method unless carbon black is extremely finely dispersed in the resin. Since the aromatic polyimide resin are thermally stable and insoluble in solvents, to adjust the resistivity, carbon black should be dispersed into a poly(amic acid) as a precursor, or a resin member should be formed by polymerization after dispersing carbon black in a monomer solution to obtain the poly(amic acid) containing a resistance controlling agent, followed by removal of solvents and conversion into an imide after forming a film from either solution as described above.

For example, JP-A No. 2001-342344 discloses use of a dispersing machine using a media, wherein acidic carbon black, having a DBP absorption of 40 $cm^3$ or more and 90 $cm^3$ or less and volatile component of 2.5 wt % by weight or more per 100 $m^2/g$ of specific surface area, is finely dispersed in a poly(amic acid) solution as a few material of polyimide. However, this method is not satisfactory for maintaining stable resistivity. Moreover, when the dispersing machine using the media is used, the production cost becomes high when an expensive resin material such as a polyimide resin is used because the amount of loss of the material is as high as 20% in the medium and vessel. In addition, various drawbacks are encountered such as defects being generated due to contamination from the media and vessel, dispersing ability changing during use due to a reduced media diameter, and the method being unusable in a high viscosity system since high speed collision of the media is necessary.

On the other hand, JP-A No. 2000-355432 discloses forming polyimide from poly(amic acid) obtained by adding an acid anhydride and a diamine to a solvent in which resistivity control agent was dispersed. However, since various functional groups on the surface of carbon black are inconvenient for the polymerization reaction of poly(amic acid), the carbon black should be deactivated in advance.

JP-A No. 2001-34074 discloses an example in which carbon black is mixed with dimethylacetamide to a proportion of 15% by weight, and is dispersed by passing through a dual collision dispersing machine having grooves with a width of 0.1 mm and a depth of 0.1 mm at a pressure of 10 $kgf/cm^2$ (about 1 MPa). However, it is thought that passing a mixture through the dual collision dispersing machine at the pressure as described above would be difficult.

JP-A No. 2001-106797 discloses a pipe-shaped polyimide containing 12% by weight (13.6 parts by weight) of a conductive material as the intermediate transfer body for obtaining a high quality transfer image with good reproducibility. However, in our testing, transfer images having sufficient image quality could not be obtained with such pipe-shaped polyimide.

SUMMARY OF THE INVENTION

As described above, while conductivity of the transfer member should be controlled to a desired level, there have been another problems that irregular transfer and decreased persistence of the surface resistivity were yet encountered even by attaining the desired resistivity.

This is believed to arise from the fact that carbon black responsible for controlling the resistivity is not uniformly and finely dispersed in the polyimide resin at a high concentration. Consequently, solving this problem is urgently desired.

Accordingly, it is an object of the present invention to provide a method for manufacturing a transfer member having desired resistivity characteristics that enables a good transfer image to be obtained while being excellent in persistence of the surface resistivity, and an image forming apparatus using the transfer member.

The problems above can be solved by the following means.

A first aspect of the invention is to provide a transfer member containing a polyimide resin and a carbon black. The carbon black has a pH value of no more than 5 and a volatile component of at least 3.5 wt %, and the content of carbon black comprises 22 to 30 parts by weight relative to 100 parts by weight of the polyimide resin.

A second aspect of the invention is to provide a transfer member, wherein the transfer member has a surface resistivity of $1\times10^8$ Ω/□ to $1\times10^{15}$ Ω/□.

DETAILED DESCRIPTION OF THE INVENTION

Figure 1A:
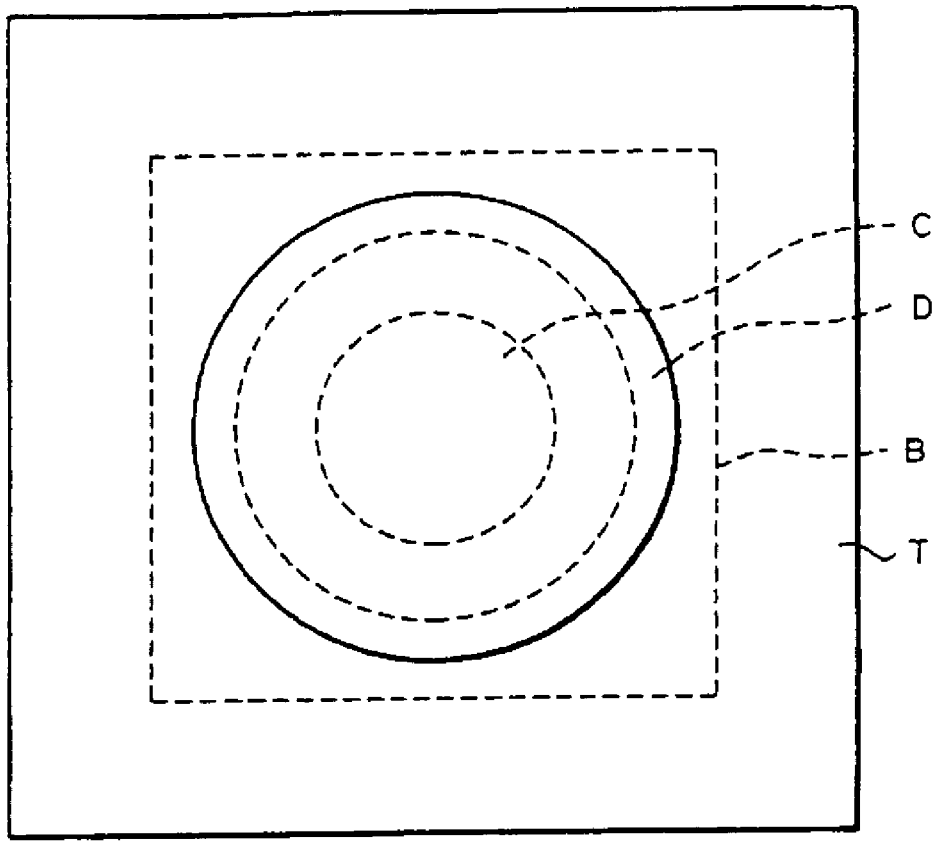
FIG. 1A is a schematic plane view showing an example of a circular electrode for measuring surface resistivity.

The present invention will be described in detail hereinafter.

Transfer Member and Method for Manufacturing the Same

The transfer member of the invention comprises a polyimide resin as a principal component, wherein the transfer member comprises 22 to 30 parts by weight of a carbon black having a pH value of no more than 5 and a volatile component of at least 3.5 wt % relative to 100 parts by weight of the polyimide resin. Because the carbon black which controls the resistivity is uniformly and finely dispersed, the transfer member of the invention can contain a high concentration of the carbon black. Accordingly, the transfer member of the invention has a desired electrical resistance characteristics to enable an excellent transfer image to be obtained without arising irregular transfer, for example, while being excellent in persistence of the surface resistivity.

A pH value of carbon black used herein is measured as follows: namely, 1 gram of the carbon black is added to 20 ml of distilled water and mixed for 1 minute, then the pH value of carbon black is measured by a glass electrode pH measuring apparatus. Details of the pH measuring method are described in ISO 787-9. Further, a volatile component rate of carbon black used herein is measured as follows: namely, certain amounts of carbon black is put into a melting pot and sealed therein with a lid, then heated in a furnace of 950° C. for 7 minutes, then the volatile component of carbon black is measured by calculating the difference between the weight of the carbon black before the heating and the weight of the carbon black after the heating. Details of the volatile component rate measuring method are described in DIN 53552.

In the transfer member of the invention, the content of carbon black having a pH value of no more than 5 and a volatile component of at least 3.5 wt %, or carbon black that is effective for controlling the resistivity, is 22 to 30 parts by weight, preferably 22 to 28 parts by weight, relative to 100 parts of the polyimide resin.

When the content of the carbon black that is responsible for controlling the resistivity is less than 22 parts by weight relative to 100 parts by weight of the polyimide resin, the degree of irregular transfer is increased so that transfer of the toner becomes impossible. On the other hand, when the content of carbon black exceeds 30 parts by weight relative to 100 parts by weight of the polyimide resin, the surface film becomes so fragile that bendability as well as the resistivity are so reduced that transferred images are disturbed.

Allowing carbon black that is responsible for controlling the resistivity to be contained in the specified amount as described above permits the transfer member of the invention to have a surface resistivity of $1\times10^{18}$ Ω/□ to $1\times10^{15}$ Ω/□, preferably $1\times10^{10}$ Ω/□ to $1\times10^{13}$ Ω/□, and more preferably $1\times10^{11}$ Ω/□ to $1\times10^{12}$ Ω/□. Too small surface resistivity induces excess electric current during transfer to cause distortion of the image, while too high surface resistivity inhibits the transfer current from flowing to make transfer of the image impossible.

Figure 1B:
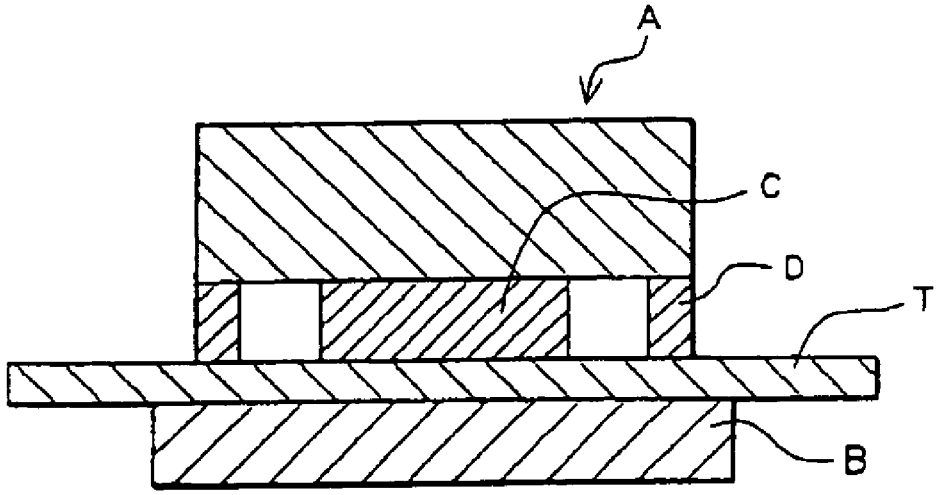
FIG. 1B is a schematic cross section of the circular electrode shown in FIG. 1A.
Figure 2A:
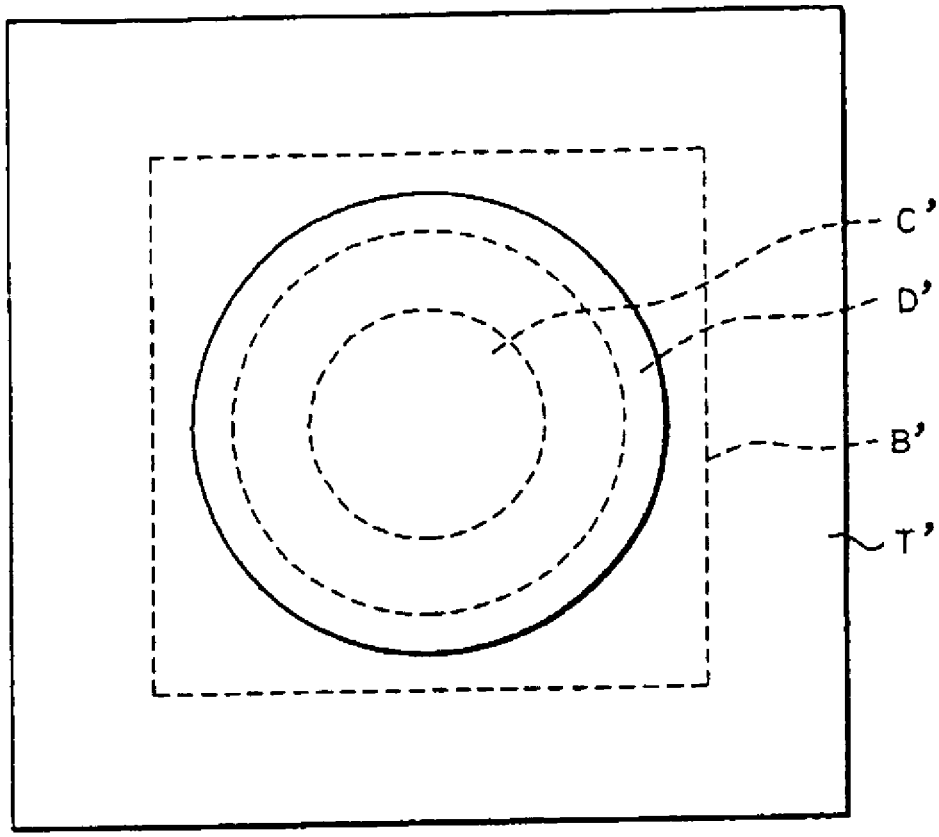
FIG. 2A is a schematic plane view showing an example of a circular electrode for measuring volume resistivity.
Figure 2B:
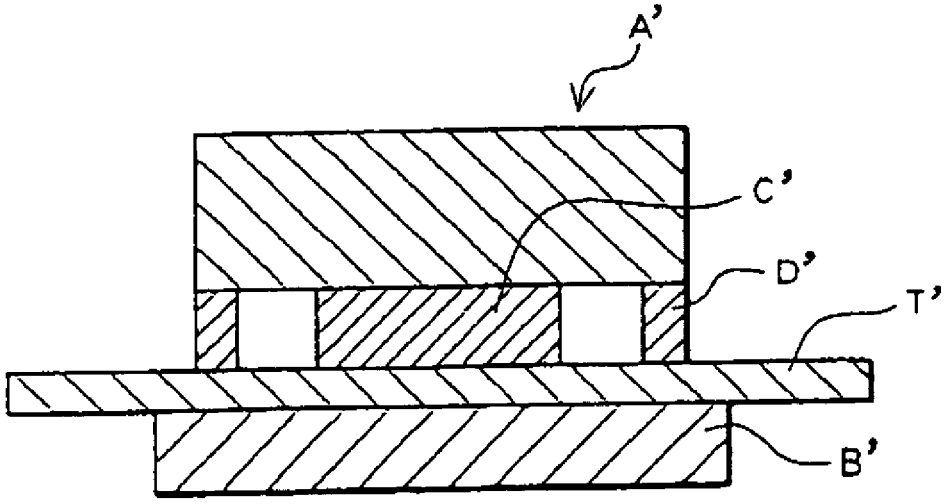
FIG. 2B is a schematic cross section of the circular electrode shown in FIG. 2A.

The surface resistivity is determined from an electric current value at 10 seconds after impressing a voltage of 100 volts by the method shown below. The surface resistivity can be measured by a conventional method using a circular electrode (for example, HR probe of Highrester IP (trade name, manufactured by Mitsubishi Chemical Co.)). In particular, for example, it can be measured using the circular electrode shown in FIGS. 1A and 1B. FIG. 1A is a schematic plane view showing an example of a circular electrode for measuring the surface resistivity, and FIG. 2B is a schematic cross section thereof. The circular electrode shown in FIGS. 1A and 1B has a first voltage impressing electrode A and an insulation plate B. The first voltage impressing electrode A comprises a round-columnar electrode C and a cylindrical ring electrode D having a larger inner diameter than the outer diameter of the round-columnar electrode C so as to surround the round-columnar electrode C with a given space. The transfer member T is interposed between the round-columnar electrode C and cylindrical ring electrode D of the first voltage impressing electrode A, and insulation plate B; the electric current I (A) flowing between the round-columnar electrode C and cylindrical ring electrode D of the first voltage impressing electrode A is measured by applying a voltage V (V); and the surface resistivity ρs (Ω/□) of the transfer member T is calculated from the following equation (1). In the equation (1), d (mm) denotes the outer diameter of the round-columnar electrode C, and D (mm) denotes the inner diameter of the cylindrical ring electrode D.

$$\rho s=\pi\times(D+d)/(D-d)\times(V/I) \quad (1)$$

The volume resistivity of the transfer member of the invention can be controlled to $1\times10^{6}$ Ω·cm to $1\times10^{13}$ Ω·cm, preferably $1\times10^{8}$ Ω·cm to $1\times10^{12}$ Ω·cm, and more preferably $1\times10^{9}$ Ω·cm to $1\times10^{11}$ Ω·cm, by allowing carbon black that is responsible for controlling the resistivity in a specified quantity to contain in the transfer member. The transferred image may be disturbed due to an excess current during transfer when the volume resistivity is too low, while the transferred image may be also disturbed due to too small electric current during transfer when the volume resistivity is too high.

The volume resistivity is determined from an electric current value at 30 seconds after impressing a voltage of 100 volts by the method shown below. The volume resistivity can be measured by a conventional method using a circular electrode as shown in FIGS. 2A and 2B (for example, HR probe of Highrester IP (trade name, manufactured by Mitsubishi Chemical Co.)). In particular, for example, it can be measured using the circular electrode shown in FIGS. 2A and 2B. FIG. 2A is a schematic plane view showing an example of a circular electrode for measuring volume resistivity, and FIG. 2B is a schematic cross section thereof.

The circular electrode shown in FIGS. 2A and 2B has a first voltage impressing electrode A' and a second voltage impression electrode B'. The first voltage impressing electrode A' comprises a round-columnar electrode C' and a cylindrical ring electrode D' having a larger inner diameter than the outer diameter of the round-columnar electrode C' so as to surround the round-columnar electrode C with a given space. The transfer member T' is interposed between the round-columnar electrode C' and cylindrical ring electrode D' of the first voltage impressing electrode A', and second voltage impression electrode B'; the electric current I (A) flowing between the round-columnar electrode C' of the first voltage impressing electrode A' and the second voltage impression electrode B' is measured by applying a voltage V (V); and the volume resistivity ps (Ω·cm) of the transfer member T' is calculated from the following equation (2). In the equation (2), t (mm) denotes the thickness of the transfer member T'.

$$\rho v=(\pi d'^2/4)\times(V/I)\times t \quad (2)$$

(d'(mm): outer diameter of the round-columnar electrode C')

The transfer member of the invention becomes to have excellent persistence of the surface resistivity with a rate of change of the surface resistivity of within ±0.8% before and after the use, by allowing carbon black to be contained in the specified range described above. The rate of change of the surface resistivity is expressed by a common logarithm of the surface resistance, which is obtained by subtracting the surface resistivity before use from the surface resistivity after the use. The density after transfer may be irregular when the rate of change of the surface resistivity exceeds ±0.8%.

The mean particle diameter of carbon black is preferably no more than 500 nm, in order to allow carbon black that is responsible for controlling the resistivity to be contained in the specified range above in the transfer member of the invention.

The surface film becomes fragile and the mechanical strength thereof becomes weak when the particle diameter of carbon black is too large.

The mean particle diameter of carbon black is measured by a dynamic light scattering measuring apparatus (trade name: PAR-III, manufactured by Otsuka Electronics Co., Ltd.). The measuring conditions are: clock rate 100 μS, accumulate 10 times, correlate channel number 128, temperature 20° C., and solvent NMP.

For satisfying the characteristics as described above in the transfer member of the invention, carbon black should be uniformly and finely dispersed in the poly(amic acid) solution as a precursor of polyimide. The method for manufacturing the transfer member capable of satisfying the characteristics above (the method for manufacturing the transfer member of the invention) will be described hereinafter.

The method of producing a transfer member comprising: dividing a polyamide resin solution containing carbon black into plural portions; mixing the divided solutions by allowing the solutions to collide with each other at a pressure of at least 150 MPa; and forming a transfer member containing the polyimide resin using the polyamide resin solution, which has the carbon black mixed therein.

In the mixing step, the carbon black is mixed in the solution of the polyamide resin as the precursor of polyimide, and the mixed solution is divided into plural portions. The polyamide resin solutions containing carbon black after dividing into plural portions are mixed by allowing the solutions to collide with each other at a pressure of at least 150 MPa. Mixing the solutions by allowing them to collide with each other at a pressure of at least 150 MPa is supposed to enable the carbon black to be finely dispersed in the poly(amic acid) solution.

The polyamide resin solutions containing the carbon black after dividing into plural portions are mixed by allowing them to collide with each other at a pressure of at least 150 MPa, preferably 150 to 250 MPa, more preferably 180 to 220 MPa. When the pressure for allowing the solutions to collide with each other is less than 150 MPa, the carbon black cannot be finely dispersed in the poly(amic acid) solution, failing in satisfying the characteristics of the above transfer member.

The mixed solution obtained by collision may be further divided into plural portions, and the divided plural portions may be mixed again by allowing them to collide with each other at a pressure of at least 150 MPa. The carbon black can be finely dispersed in the poly(amic acid) solution with good efficiency by repeating this operation twice or more.

Figure 3:
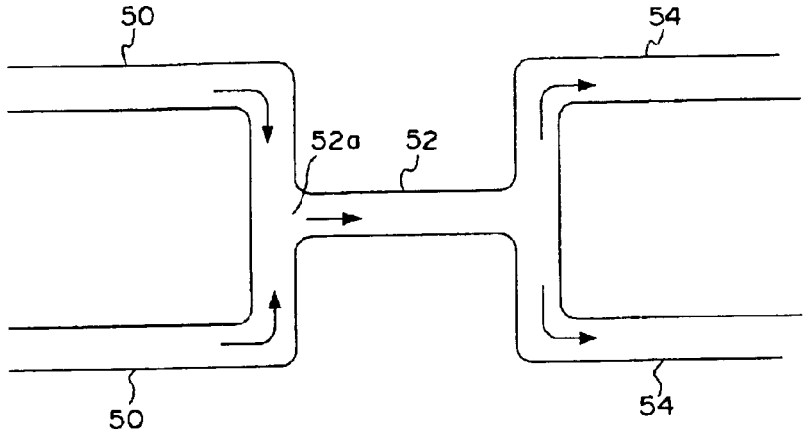
FIG. 3 illustrates a division and mixing mechanism of the poly(amic acid) solution containing carbon black in the method for manufacturing the transfer member according to the invention.

The division and mixing mechanism will be described with reference to drawings, wherein the poly(amic acid) solutions containing the carbon black after dividing into plural portions is mixed by allowing them to collide with each other, and the mixed solution is further divided into plural portions. FIG. 3 is provided for illustrating the division and mixing mechanism of the poly(amic acid) solution containing carbon black in the method for producing the transfer member of the invention.

The poly(amic acid) resin solution containing the carbon black is divided and mixed by flowing the solution in a flow path comprising two first flow path tubes 50 connected at a joint from the upstream to the downstream of the tubes, a connection tube 52 constituting a connection portion, and second flow path tubes 54 branching into plural tubes from one end of the connection tube 52*a* as shown in FIG. 3.

The polyamide resin solution containing the carbon black is at first divided into two portions by flowing the solution into two first flow path tubes 50, the flow pressure of the solutions are controlled at least 150 MPa, and the divided solutions are allowed to collide with each other at near the end 52*a* of the connection tube 52 constituting the connection portion at a pressure of at least 150 MPa. The mixed solution after collision passes through the connection tube 52, and divided into two portions again by allowing the solution to flow into second flow path tubes 54 branched into plural tubes. The mixed solutions divided into two portions may be allowed to flow into the first flow path tube 50 again for repeating mixing and division plural times.

In the division and mixing mechanism shown in FIG. 3, the polyamide resin solution containing the carbon black is made to flow into the two first flow path tubes 50 connected at a joint from the upstream to the downstream at a pressure of at least 150 MPa. Consequently, a shear force as well as a collision force is given to the solution at a pressure of at least 150 MPa, enabling the carbon black of high concentration to be uniformly and finely dispersed with high efficiency.

While the mixed solution after the collision passes through the connection tube 52, carbon black may be finely dispersed in the poly(amic acid) solution by adjusting the minimum cross sectional area of the connection portion between the two first flow path tubes 50 (in the vicinity of one end 52*a* of the connection tube 52 in the drawing), or the collision portion for allowing two solutions with each other, to be no more than 0.07 $mm^2$ (preferably in a range of 0.007 to 0.05 $mm^2$, more preferably in a range of 0.015 to 0.04 $mm^2$). Although the reason thereof is not clear, a shear force and collision pressure may be efficiently given to the solution by reducing the collision area between the solutions at a pressure of at least 150 MPa, suggesting that carbon black can be finely dispersed in the poly(amic acid) solution. The minimum cross sectional area of the collision portion for allowing the two solutions to collide corresponds to the cross sectional area of the flow path tubes 50 in the vicinity of the inlet of the connection tube 52 in the drawing.

An example of favorable collision dispersing machines having such dispersion and mixing mechanism is Geanus PY (trade name, manufactured by Geanus Co.). Other examples available include Altemizer (trade name, manufactured by Sugino Machine Limited), and Nanomizer (trade name, manufactured by Nanomizer Co.) as the collision dispersing machines.

While the poly(amic acid) solution containing carbon black is divided and mixed in the mixing step, as described above, carbon black aggregates with a size of several tens micrometers supposed to be a result of collision may be formed in the poly(amic acid) solution containing carbon black after dispersion with the collision dispersion machine. Although the presence of such aggregates may cause little troubles, the carbon black aggregates may be removed by passing the poly(amic acid) solution containing carbon black after division and mixing through a filter having a pore size of, for example, 25 $\mu$m or less, enabling a transfer member containing favorably and finely dispersed carbon black to be obtained.

In the following forming step, the polyamide resin solution containing the carbon black after mixing in the mixing step is coated on the outer circumference face or inner circumference face of, for example, a cylindrical die to form a coating film. Coating methods known in the art such as a dip-coating method and a centrifugal film forming method may be used in this film-forming step.

The totally aromatic poly(amic acid) solution as a precursor of polyimide may be obtained by a reaction of a tetracarboxylic acid anhydride and a diamine. Examples of the tetracarboxylic acid dianhydride include pyrromellitic acid dianhydride, 3,3',4,4',-biphenyltetracarboxylic acid dianhydride, and a mixture thereof. Examples of the diamine include paraphenylene diamine and 4,4'-diaminodiphenyl ether.

Particularly, the poly(amic acid) comprising 3,3',4,4-biphenyl tetracarboxylic acid dianhydride and 4,4'-diaminodiphenyl ether, poly(amic acid) comprising 3,3',4,4-biphenyl tetracarboxylic acid dianhydride and paraphenylene diamine, and poly(amic acid) comprising pyrromellitic acid dianhydride and 4,4'-diaminodiphenyl ether are able to efficiently and finely disperse carbon black, indicating that these compounds are suitable for satisfying the characteristics of the transfer member.

While the carbon black that is responsible for controlling resistivity is not particularly restricted so long as it has a pH value of no more than 5 and a volatile component of at least 3.5 wt %, commonly used carbon black such as oil furnace black and channel black are available. Carbon black is not required to be one kind, and plural kinds of carbon black may be blended for use.

Examples of solvents for the totally aromatic poly(amic acid) solution include amide based solvents such as dimethylformamide (DMF) and N-methyl-2-pyrrolidone (NMP), and a small amount of an aromatic hydrocarbon may be mixed with these solvents for adjusting the viscosity.

Subsequently, a film of the totally aromatic polyimide is formed by converting the coating film of the totally aromatic poly(amic acid) solution formed on the die into a polyimide film.

While the solvent is removed by drying before converting the coating film of the totally aromatic poly(amic acid) solution into the polyimide film, the coating film of the totally aromatic poly(amic acid) solution after removing the solvent may be taken out of the die, and attached to another die in some cases. The other die for attaching the coating film used has a little smaller diameter than the diameter of the coating film of the totally aromatic poly(amic acid) solution after removing the solvent. Since the coating film is often largely contracted when the coating film of the totally aromatic poly(amic acid) solution is converted into the polyimide film, the diameter of the other die should have a little smaller diameter in order to prevent the polyimide resin film from being deformed.

The coating film of the totally aromatic poly(amic acid) solution after removing the solvent is converted into the polyimide film by heating to form a polyimide resin film.

Finally, the totally aromatic polyimide resin film formed on the outer peripheral face of the die (or the other die) is taken out of the die, and cut into pieces having an appropriate width to obtain the transfer member made of the polyimide resin.

The transfer member of the invention explained (or the method for manufacturing the same) can be used as an intermediate transfer body used for an electrostatic image forming apparatus by an electrostatic copying process such as a printer and copy machine.

Image Forming Apparatus

The image forming apparatus of the invention is not particularly restricted so long as the device is an image forming apparatus having an intermediate transfer body and an image forming apparatus comprising a printing paper sheet feed belt. Examples of such image forming apparatus include a conventional monochromatic image forming apparatus comprising a monochromatic toner housed in a developer vessel, a color image forming apparatus in which primary transfer of toner images retained on the surface of an image retaining body such as a photosensitive drum on the intermediate transfer body are successively repeated, and a color image forming apparatus of a tandem type in which plural image retaining bodies comprising developer vessels for respective colors are linearly arranged on the intermediate transfer body.

Figure 4:
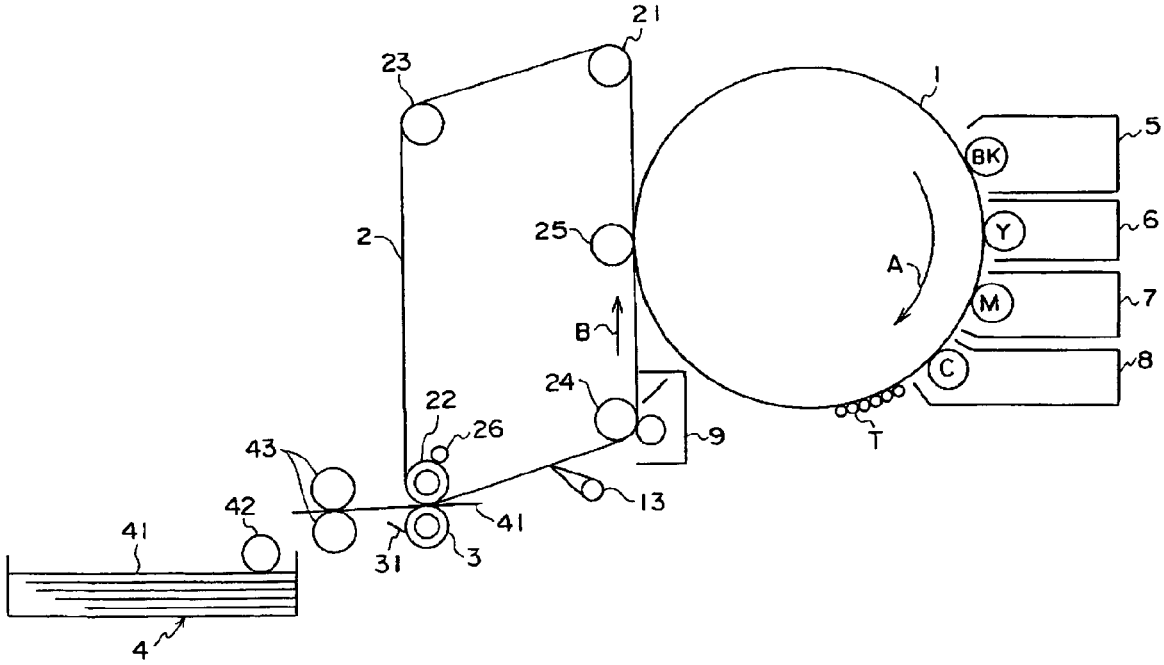
FIG. 4 is a schematic drawing showing an example of the image forming apparatus of the invention.

The color image forming apparatus for repeating primary transfer will be described hereinafter as an example of the image forming apparatus of the invention. FIG. 4 illustrates a schematic constitution of an example of the image forming apparatus of the invention.

The image forming apparatus in FIG. 4 comprises a photosensitive drum 1 as an image retaining member, a transfer belt 2 as an intermediate transfer body, a bias roll 3 as a transfer electrode, a tray 4 for feeding recording paper sheets as recording media, a developer vessel 5 using a Bk (black) toner, a developer vessel 6 using a Y (yellow) toner, a developer vessel 7 using an M (magenta) toner, a developer vessel 8 using a C (cyan) toner, a belt cleaner 9, a peeling nail 13, belt rolls 21, 23 and 24, a back-up roll 22, a conductive roll 25, an electrode roll 26, a cleaning blade 31, a pick-up roll 42, and feed rolls 43. The transfer belt 2 comprises a semiconductive belt of the above invention.

The photoconductive drum 1 rotates in the direction indicated by the arrow A in the drawing, and the surface of the drum is uniformly electrified with an electrification device (not shown). An electrostatic latent image for the first color (for example, Bk) is formed on the electrified photoconductive drum 1 with an image writing means such as a laser writing device. The electrostatic latent image is developed by the developer vessel 5 to form a visualized toner image T. The toner image T arrives at a primary transfer portion on which the conductive roll 25 is disposed by rotating the photosensitive drum 1. Then, the toner image T is electrostatically adsorbed onto the transfer belt 2 by applying an inverse polarity electric field from the conductive roll 25 to the toner image T, and is primary transferred onto the transfer belt 2 by rotating the belt in the direction indicated by the arrow B.

The toner images of the second, third and fourth colors are sequentially formed thereafter by the same method as described above, and are overlaid on the surface of the transfer belt 2 with each other to form a multiple toner image.

The multiple toner image transferred to the transfer belt 2 arrives at a secondary transfer portion where the bias roll 13 is disposed by rotating the transfer belt 2. The secondary transfer portion comprises the bias roll 3 disposed at the surface side of the transfer belt 2 retaining the toner image, the back-up roll 22 disposed so as to face the bias roll 3 from the back side of the transfer belt 2, and the electrode roll 26 rotating by being compressed onto the back-up roll 22.

The recording paper sheet 41 (recording medium) is taken out of a stack of the recording paper sheets housed in the recording paper sheet tray 4 one by one with the pick-up roll 42, and is fed between the transfer belt 2 and bias roll 3 of the secondary transfer portion with the feed rolls 43 at a given timing. The toner image retained on the surface of the transfer belt 2 is transferred onto the recording paper sheet 41 fed from the feed rolls 43 by compressed transfer with the bias roll 3 and back-up roll 22, and by rotation of the transfer belt 2.

The recording paper sheet 41 onto which the toner image is transferred is peeled from the transfer belt 2 by operating the peeling nail 13 that has been in a waiting position before completing primary transfer of the final toner image. The recording paper sheet is then transferred to a fixing device (not shown), and is turned into a permanent image by fixing the toner image on the recording paper sheet 41 by compression and heating.

The remaining toner on the transfer belt 2 after completing transfer of the multiple toner image onto the recording paper sheet 41 is removed with the belt cleaner 9 provided at the downstream of the secondary transfer portion so as to be ready for succeeding transfer. The cleaning blade 31 made of polyurethane is always standing so as in contact with the bias roll 3, in order to remove foreign substances such as toner particles and paper dust adhered during transfer.

While the toner image T after primary transfer is immediately subjected to secondary transfer to transfer the image to a fixing device in the case of transfer of a monochromatic image, rotation of the transfer belt 2 is synchronized with rotation of the photosensitive drum 1 in the case of transfer of a multi-color image formed by overlap of plural colors in order to avoid the color toner images from being shifted with each other, so that the toner images of respective colors are precisely aligned at the primary transfer portion.

The toner image is transferred onto the recording paper sheet 41 in the secondary transfer portion by electrostatic repulsion by applying an output voltage (transfer voltage) having the same polarity as the polarity of the toner image onto the electrode roll 26 compressed onto the back-up roll 22 facing the recording paper sheet with interposition of the bias roll 3 and transfer belt 2.

The image can be formed as described above.

EXAMPLES

While the invention is described in more detail with reference to examples, the invention is by no means restricted to the examples.

Example 1

Added in U-vanish S (trade name, manufactured by Ube Industries, Ltd., as a NMP solution of poly(amic acid) comprising 3,3',4,4'-biphenyl tetracarboxylic acid dianhydride and paraphenylene diamine and having a solid content of 18 wt % after converting into polyimide) is 24.1 phr of carbon black (trade name: Special Black 4 manufactured by Degussa Co.; pH=3, volatile component 14 wt %). The solution is divided into two portions, and the divided solutions are allowed to collide with each other at a pressure of 200 MPa using Geanus PY (trade name, manufactured by Geanus Co.; the minimum cross sectional area of the collision portion: 0.032 $mm^2$) having the same mechanism as the division and mixing mechanism as shown in FIG. 3. The solutions are mixed by passing through the path in FIG. 3 five times.

The mixed solution is coated on the outer surface of a die having a diameter of 305 mm by a dip method, and 70% of NMP as the solvent is removed by placing the die in a drying chamber set at 175° C. After cooling the die by taking out of the chamber, a cylindrical film of poly(amic acid) prepared is removed from the die to insert a die having an outer diameter of 302 mm into the cylindrical film. Poly(amic acid) is converted into polyimide by heating the film to 380° C., and the polyimide film is removed from the die to prepare a polyimide belt with a thickness of 70 $\mu$m.

Example 2

Added in U-vanish S manufactured by Ube Industries, Ltd. (as described above) is 23.2 phr of carbon black (trade name: Special Black 4 described above). The solution is divided into two portions, and the divided solutions are allowed to collide with each other at a pressure of 175 MPa using Geanus PY (as described above) having the same mechanism as the division and mixing mechanism as shown in FIG. 3. The solutions are mixed by passing through the path in FIG. 3 five times.

A polyimide belt with a thickness of 70 $\mu$m is manufactured by the same method as in Example 1 using the solution above.

Example 3

Added in U-vanish S (as described above) is 22 phr of carbon black (trade name: Special Black 4 described above). The solution is divided into two portions, and the divided solutions are allowed to collide with each other at a pressure of 150 MPa using Geanus PY (as described above) having the same mechanism as the division and mixing mechanism as shown in FIG. 3. The solutions are mixed by passing through the path in FIG. 3 five times.

A polyimide belt with a thickness of 70 $\mu$m is manufactured by the same method as in Example 1 using the solution above.

Example 4

The mixed solution in Example 1 is filtered through a sintered mesh filter with a pore diameter of 25 μm, and a polyimide belt with a thickness of 70 μm is manufactured by the same method as in Example 1 using the solution above.

Example 5

Added in U-vanish A (trade name, manufactured by Ube Industries, Ltd., as a NMP solution of poly(amic acid) comprising 3,3',4,4'-biphenyl tetracarboxylic acid dianhydride and 4,4'-diaminodiphenyl ether and having a solid content of 18 wt % after converting into polyimide) is 27 phr of carbon black (Special Black 4 described above). The solution is dispersed and coated to prepare a film, and the film is dried and convert into polyimide to prepare a polyimide belt with a thickness of 73 μm by the same method as in Example 1.

Example 6

Added in U-vanish S (as described above) is 22 phr of carbon black (trade name: MOGUL-L, manufactured by Cabot Co.; pH=2.5, volatile component 4.5 wt %). The solution is divided into two portions, and the divided solutions are allowed to collide with each other at a pressure of 200 MPa using Geanus PY (described above) having the same mechanism as the division and mixing mechanism as shown in FIG. 3. The solutions are mixed by passing through the path in FIG. 3 five times.

A polyimide belt with a thickness of 70 μm is prepared using the solution by the same method as in Example 1.

Comparative Example 1

Added in U-vanish S (as described above) is 20.5 phr of carbon black (Special Black 4 described above). The solution is divided into two portions, and the divided solutions are allowed to collide with each other at a pressure of 100 MPa using Geanus PY (described above) having the same mechanism as the division and mixing mechanism as shown in FIG. 3. The solutions are mixed by passing through the path in FIG. 3 five times.

A polyimide belt with a thickness of 70 μm is prepared using the solution by the same method as in Example 1.

Comparative Example 2

Added in U-vanish S (as described above) is 30 phr of carbon black (trade name: Special Black 250, manufactured by Degussa Co; pH=3.1, volatile component 2.2 wt %). The solution is divided into two portions, and the divided solutions are allowed to collide with each other at a pressure of 200 MPa using Geanus PY (described above) having the same mechanism as the division and mixing mechanism as shown in FIG. 3. The solutions are mixed by passing a two-division flow path five times.

A polyimide belt with a thickness of 70 μm is prepared using the solution by the same method as in Example 1.

Comparative Example 3

Added in U-vanish S (as described above) is 8 phr of carbon black (trade name: Acetylene Black, manufactured by Denki Kagaku Kogyo Kabushiki kaisha; pH=7, volatile component 0.25 wt %). The solution is divided into two portions, and the divided solutions are allowed to collide with each other at a pressure of 200 MPa using Geanus PY (described above) having the same mechanism as the division and mixing mechanism as shown in FIG. 3. The solutions are mixed by passing through the path in FIG. 3 five times.

A polyimide belt with a thickness of 70 μm is prepared using the solution by the same method as in Example 1.

Comparative Example 4

Added in U-vanish S (as described above) is 14 phr of carbon black (Special Black 4 as described above) by the same method as in Example 1, and the solution is mixed by passing through a horizontal sand mill (trade name: Dyno-Mill KDL, manufactured by Dyno Co.) five times. The sand mill is filled with zirconia spheres with a diameter of 2 mm in an inner volume ratio of about 60%, and the spheres are rolled with a stirring blade with a diameter of 90 mm at a rotation speed of 1592 rpm so as to mixes by passing five times.

A polyimide belt with a thickness of 70 μm is prepared using the mixed dispersion above by the same method as in Example 1.

Evaluation

The results in the examples and comparative examples are evaluated as follows. The results are shown in Table 1.

Surface Resistivity

The surface resistivity is measured using the circular electrode (trade name: HR probe of Highrester IP, manufactured by Mitsubishi Chemical Co.; outer diameter of the round columnar electrode C of 16 mm; inner diameter and outer diameter of the cylindrical ring electrode D of 30 mm and 40 mm, respectively) shown in FIGS. 1A and 1B. An electric current is measured 10 seconds after applying a voltage of 100 V, and the resistivity is calculated as described previously.

Volume Resistivity

The volume resistivity is measured using the circular electrode (trade name: HR probe of Highrester IP, manufactured by Mitsubishi Chemical Co.; outer diameter of the round columnar electrode C of 16 mm; inner diameter and outer diameter of the cylindrical ring electrode D of 30 mm and 40 mm, respectively) shown in FIGS. 1A and 1B. An electric current is measured 30 seconds after applying a voltage of 100 V, and the resistivity is calculated as described previously.

Rate of Change of Surface Resistivity

The polyimide belt obtained in each example and comparative example is assembled into a laser printer (trade name: DPC 2220, manufactured by Fuji Xerox Co., Ltd.), and the image is copied on 30,000 sheets of A-4 size vertical paper under a circumference of 10° C. and 15% RH. The surface resistivity of the polyimide belt at the portions where copy paper sheets have not passed through is measured by the method as described previously. The rate of change of the surface resistivity is calculated by subtracting the surface resistivity after the test from the surface resistivity before the test. A value of this rate of change of exceeding ±0.8 indicates that irregular densities are caused during transfer.

Mean Particle Diameter of Carbon Black

The particle diameter is measured with respect to the dispersion solution comprising carbon black dispersed in poly(amic acid) vanish by a dynamic light scattering measuring apparatus (trade name: PAR-III, manufactured by Otsuka Electronics Co., Ltd.) in each example. The measuring conditions are: clock rate 100 $\mu$S; accumulate time 10 times; correlate channels 128; temperature 20° C.; solvent NMP. A median of number average particle diameter is defined as the average particle diameter.

Surface property

The polyimide belt obtained in each example and comparative example is observed by naked eyes, and evaluated by the following criteria:

⊙: No protrusions/glossiness on the surface by naked eyes.

○: Protrusions of several microns/glossiness on the surface.

X: Protrusions/no glossiness on the surface. Irregular image density

The polyimide belt obtained in each example and comparative example is assembled into a laser printer (trade name: DPC 2220, manufactured by Fuji Xerox Co., Ltd.). Images obtained by transferring half-tone magenta images (30% of magenta) on sheets of A-3 size vertical paper are observed by naked eyes, and evaluated by the following criteria:

⊙: No irregular density.

○: Slightly irregular density.

Δ: Irregular density.

X: Evaluation is impossible.

TABLE 1

| | CB content (phr) | Surface resistivity (Ω/□) | Volume resistivity (Ω · cm) | Mean particle diameter of CB ($\mu$m) | Rate of change of surface resistivity (Ω/□) | Surface property | Image density |
|---|---|---|---|---|---|---|---|
| Example 1 | 24.1 | $5.4 \times 10^{11}$ | $9.8 \times 10^{9}$ | 220 | −0.58 | ○ | ⊙ |
| Example 2 | 23.2 | $2.3 \times 10^{10}$ | $8.5 \times 10^{8}$ | 245 | −0.63 | ○ | ⊙ |
| Example 3 | 22.0 | $7.6 \times 10^{10}$ | $9.1 \times 10^{8}$ | 281 | −0.79 | ○ | ○ |
| Example 4 | 24.1 | $5.4 \times 10^{11}$ | $9.8 \times 10^{9}$ | 220 | −0.55 | ⊙ | ⊙ |
| Example 5 | 27 | $8.3 \times 10^{11}$ | $1.8 \times 10^{11}$ | 215 | −0.14 | ○ | ⊙ |
| Example 6 | 22.1 | $8.7 \times 10^{10}$ | $9.8 \times 10^{9}$ | 320 | −0.55 | ○ | ○ |
| Comparative example 1 | 20 | $6.0 \times 10^{9}$ | $1.7 \times 10^{10}$ | 224 | −0.75 | X | X |
| Comparative example 2 | 32 | $7.8 \times 10^{12}$ | $4.3 \times 10^{8}$ | 264 | −3.2 | ○ | Δ |
| Comparative example 3 | 8 | $5.2 \times 10^{10}$ | $7.2 \times 10^{8}$ | 720 | −2.1 | ○ | Δ |
| Comparative example 4 | 14 | $3.8 \times 10^{11}$ | $5.6 \times 10^{9}$ | 256 | −0.85 | ○ | Δ |

The results in Table 1 show that carbon black is finely dispersed in the transfer member in the examples containing a high concentration of carbon black for controlling resistivity, resulting in the belt having excellent characteristics. The pressure for allowing the solutions to collide with each other after dividing the solution in two portions should be at least 150 MPa, in order to permit carbon black that is responsible for controlling resistivity to contain in a high concentration, or in order to uniformly and finely disperse carbon black. Moreover, carbon black can be finely dispersed by allowing the solutions to collide with each other at a collision portion of the collision mixing machine having a minimum cross sectional area of the collision portion (the region for allowing the solutions after dividing into two portions to collide) of as fine as 0.032 $mm^2$.

Carbon black that is responsible for controlling resistivity is uniformly and finely dispersed in a high concentration in the transfer member in Example 4 using U-vanish A (as described above) as kind of the polyimide resin, as compared with the transfer member in comparison with Example 1. Accordingly, good results are obtained in the example with respect to persistence of the surface resistivity and uniform image density.

It is also shown that using carbon black after an oxidation treatment makes it possible to largely reduce incidence of irregular density during transfer as shown in Example 1. This is probably because microscopic irregularity of electrical resistance is eliminated since carbon black after the oxidation treatment is possible to be uniformly and finely dispersed effectively.

On the contrary, carbon black for controlling resistivity is not contained in high concentration in Comparative Example 1 in which the pressure for allowing the solutions after dividing in two portions is less than 150 MPa. Consequently, many protrusions ascribed to non-dispersed carbon black appear on the surface of the belt, making it difficult to use the belt as the transfer member. Although a desired resistivity may be obtained due to a small content of carbon black for controlling resistivity in Comparative Example 4 in which carbon black is dispersed using a beads mill, the rate of change of resistivity is large due to a small degree of dispersion of carbon black, resulting in irregular image density.

As explained above, according to the invention, the invention provides a transfer member having desired resistivity characteristics capable of obtaining an excellent transfer image while having excellent persistence of the surface resistivity. The invention also provides a method for manufacturing the transfer member, and an image forming apparatus using the transfer member.

What is claimed is:

1. A transfer member comprising: a polyimide resin and a carbon black, wherein:

the carbon black has a pH value of no more than 5 and a volatile component of at least 3.5 wt %;

the carbon black is dispersed by colliding under a pressure of 150 MPa or more;

the content of the carbon black comprises 22 to 30 parts by weight relative to 100 parts by weight of the polyimide resin;

the transfer member has a surface resistivity of $1\times10^{8}$ Ω/□ to $1\times10^{15}$ Ω/□; and the transfer member has a volume resistivity of $1\times10^{6}$ Ω·cm to $1\times10^{13}$ Ω·cm.

2. A transfer member according to claim 1, wherein the average particle diameter of the carbon black is no more than 500 nm.

3. A method of producing a transfer member comprising:

dividing a poly(amic acid) resin solution containing carbon black into plural portions;

mixing the divided solutions by allowing the solutions to collide with each other at a pressure of at least 150 MPa; and forming a transfer member containing the polyimide resin using the poly(amic acid) resin solution, which has the carbon black mixed therein;

wherein the carbon black has a pH value of no more than 5 and a volatile component of at least 3.5 wt %; and wherein the transfer member has a surface resistivity of $1\times10^{8}$ Ω/□ to $1\times10^{15}$ Ω/□ and a volume resistivity of $1\times10^{6}$ Ω/·cm to $1\times10^{13}$ Ω·cm.

4. A method for manufacturing the transfer member according to claim 3, wherein the mixing comprises:

applying the respective divided solutions to each upstream side of plural flow path tubes that converge so as to be connected with each other at a connection portion at a downstream side of the flow path tubes;

allowing the respective divided solutions to flow through the flow path tubes under a pressure of at least 150 MPa; and allowing the respective solutions which have flowed through the flow path tubes to collide with each other at the connection portion of the flow path tubes.

5. A method for manufacturing the transfer member according to claim 4, wherein a minimum cross sectional area of the connection portion of plural flow path tubes is no more than 0.07 $mm^2$.

6. A method for manufacturing the transfer member according to claim 3, wherein the mixing step further comprises dividing the solution into plural portions after the collision.

7. A method for manufacturing the transfer member according to claim 6, wherein the mixing step comprises:

applying the respective divided solutions to respective upstream sides of plural first flow passage tubes that converge so as to be connected at a connection portion at a downstream side of the flow paths;

allowing the respective divided solutions to flow through the first flow path tubes under a pressure of at least 150 MPa;

allowing the solutions which have flowed through the respective flow path tubes to collide with each other at the connection portion of the first flow path tubes; and dividing the solution after the collision into plural portions by allowing the solutions to flow into plural second flow path tubes that diverge from the connection portion of the first flow path tubes.

8. A method for manufacturing the transfer member according to claim 6, wherein collision among the divided solutions and re-division of the solution after the collision are repeated plural times in the mixing step.

9. A method for manufacturing the transfer member according to claim 3, further comprising filtering the mixed solution using a filter after the mixing step.

10. A method for manufacturing the transfer member according to claim 3, wherein the divided solutions are allowed to collide with each other at a pressure of 150 to 250 Mpa in the mixing step.

11. A method for manufacturing the transfer member according to claim 3, wherein the divided solutions are allowed to collide with each other at a pressure of 180 to 220 Mpa in the mixing step.

12. An image forming apparatus comprising a transfer member containing a polyimide resin and carbon black, the carbon black having a pH value of no more than 5 and a volatile component of at least 3.5%, the content of the carbon black being 22 to 30 parts by weight relative to 100 parts by weight of the polyimide resin;

wherein the carbon black is dispersed by colliding under a pressure of 150 MPa or more; and wherein the transfer member has a surface resistivity of $1\times10^{8}$ Ω/□ to $1\times10^{15}$ Ω/□ and a volume resistivity of $1\times10^{6}$ Ω/·cm to $1\times10^{13}$ Ω·cm.

13. An image forming apparatus according to claim 12, wherein the mean particle diameter of the carbon black is no more than 500 nm.

* * * * *